US006793387B1

(12) United States Patent
Neas et al.

(10) Patent No.: US 6,793,387 B1
(45) Date of Patent: Sep. 21, 2004

(54) APPARATUS FOR AUTOMATIC PREPARATION OF A MIXTURE AND METHOD

(75) Inventors: Edwin D. Neas, Nunn, CO (US); Dennis L. Templar, Fort Collins, CO (US); Harry J. Tiffany, III, Weldona, CO (US)

(73) Assignee: Chata Biosystems, Inc., Fort Collins, CO (US)

( * ) Notice: Subject to any disclaimer, the term of this patent is extended or adjusted under 35 U.S.C. 154(b) by 0 days.

(21) Appl. No.: 10/030,659

(22) PCT Filed: May 6, 2000

(86) PCT No.: PCT/US00/12229

§ 371 (c)(1),
(2), (4) Date: Jan. 7, 2002

(87) PCT Pub. No.: WO00/68137

PCT Pub. Date: Nov. 16, 2000

(30) Foreign Application Priority Data

May 8, 1999 (US) ..... 60133251

(51) Int. Cl.[7] ..... B67D 5/52; B67D 5/60; B65B 43/50; B01F 15/02

(52) U.S. Cl. ..... 366/160.4; 222/94; 222/106; 222/135; 222/144; 141/104; 141/231; 366/182.2

(58) Field of Search ..... 222/92, 94, 105, 222/106, 107, 1, 132, 135, 137, 144, 144.5, 168.5; 141/231, 100, 101, 104, 144, 145, 146; 366/160.1–160.5, 152.1, 152.2, 182.2, 183.1

(56) References Cited

U.S. PATENT DOCUMENTS

| | | | | | |
|---|---|---|---|---|---|
| 3,122,272 | A | | 2/1964 | Marsh | 222/26 |
| 3,870,466 | A | | 3/1975 | Rellstab | 23/230 |
| 4,027,785 | A | * | 6/1977 | Edstrom et al. | |
| 4,258,759 | A | | 3/1981 | Achen | 141/100 |
| 4,279,991 | A | | 7/1981 | Hagen et al. | 435/4 |
| 4,403,866 | A | | 9/1983 | Falcoff et al. | 366/132 |
| 4,515,753 | A | | 5/1985 | Smith et al. | 422/102 |
| 4,623,008 | A | | 11/1986 | Shibata et al. | 141/89 |
| 4,676,286 | A | | 6/1987 | Aiuola et al. | 141/145 |
| 4,946,100 | A | | 8/1990 | Flemming et al. | 239/1 |
| 5,060,825 | A | * | 10/1991 | Palmer et al. | 222/94 |
| 5,061,639 | A | | 10/1991 | Lung et al. | 436/164 |
| 5,078,302 | A | | 1/1992 | Hellenberg | 222/144 |
| 5,104,621 | A | | 4/1992 | Pfost et al. | 422/67 |
| 5,114,045 | A | * | 5/1992 | Herpe | 222/105 |
| 5,119,973 | A | | 6/1992 | Miller et al. | 222/144 |
| 5,369,566 | A | | 11/1994 | Pfost et al. | 364/147 |
| 5,402,834 | A | | 4/1995 | Levin et al. | 141/83 |
| 5,451,528 | A | | 9/1995 | Raymoure et al. | 436/533 |
| 5,460,209 | A | | 10/1995 | Jandura et al. | 141/83 |
| 5,474,211 | A | | 12/1995 | Hellenberg | 222/1 |
| 5,597,733 | A | | 1/1997 | Bell et al. | 436/54 |
| 5,637,275 | A | | 6/1997 | Carey et al. | 422/64 |
| 5,746,982 | A | | 5/1998 | Saneii et al. | 422/134 |
| 5,865,224 | A | | 2/1999 | Alley et al. | 141/130 |
| 2003/0080140 | A1 | * | 5/2003 | Neas et al. | 222/92 |

* cited by examiner

*Primary Examiner*—Charles E. Cooley
(74) *Attorney, Agent, or Firm*—Macheledt Bales LLP

(57) ABSTRACT

An apparatus and associated method of preparing a mixture using a computerized apparatus having a plurality of vessels, each of which is arranged on a support structure and oriented for dispensing a fluent substance through at least one exit port and a first flow channel. Each first flow channel is in further communication with a dedicated measurement assembly, for dosing fluent substance so dispensed, and a second flow channel. The apparatus also includes a receptacle support; and can further incorporate a user interface for receiving a first input concerning the mixture plus a storage device to hold instructions for locating a respective one of the second flow channels and the receptacle support in operative relation. The apparatus can further comprise titration and mixing modules; and an alternative apparatus and method can utilize a support structure having a framework moveably coupled to a sustaining member, whereby many flexible-walled vessels can be accommodated.

24 Claims, 11 Drawing Sheets

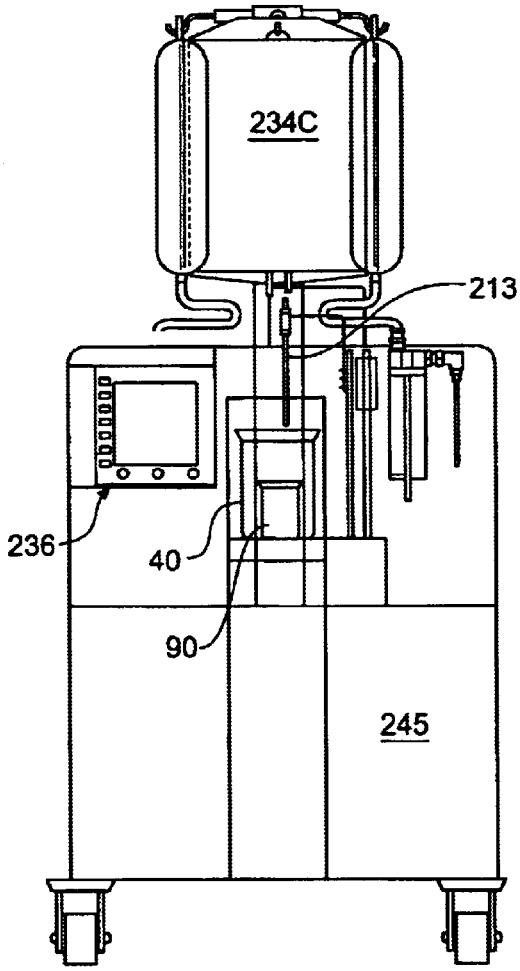
FIG. 7B
FIG. 7C
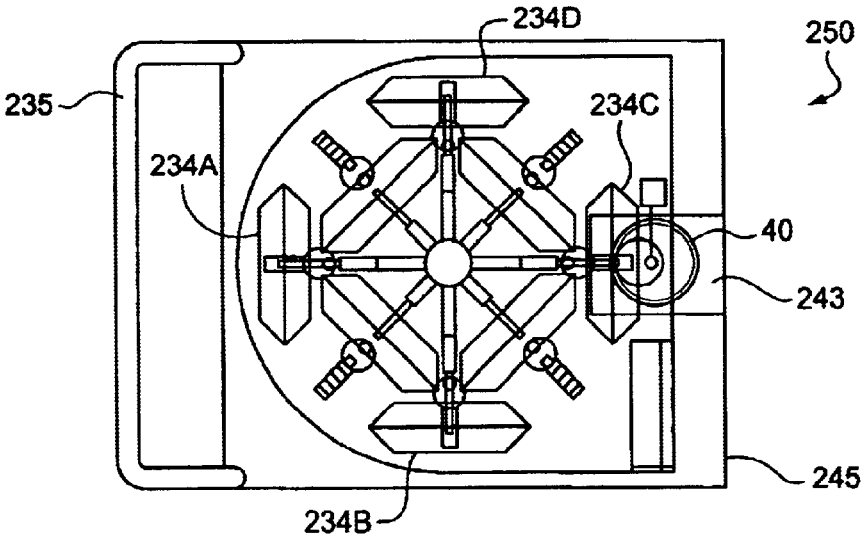

APPARATUS FOR AUTOMATIC PREPARATION OF A MIXTURE AND METHOD

BACKGROUND OF THE INVENTION

In general, the present invention relates to the preparation of mixtures including liquid reagents, cleaning and other special-purpose solutions, solvents, pesticides, herbicides, paints, mixed beverages, fluent foodstuff, as well as other fluent substances used in the laboratory, manufacturing plant floor, field crops, gardens, eating establishments, building structures, art lab, and so on. Common to the preparation of such a wide range of types of mixtures are the tasks of selecting, dosing, and mixing the necessary constituent fluent components into a receptacle. More particularly, the invention relates to the automation of such mixture preparation using a novel apparatus, whether the constituent components are uniformly distributed within the mixture. This apparatus and associated method utilizes a unique automated technique to, in accordance with input concerning a desired end-product, select at least one of a plurality of available fluent constituent components staged on a support structure, dose/measure a requisite amount of each selected constituent component, collect the dosed amount with mixing receptacle, and agitate/stir the collected contents in the receptacle to prepare the preselected end-product. A processor and storage device are readily adapted to collect and store data concerning the preparation, as desired. The footprint of the apparatus can be chosen for portability. And although a variety of vessels containing constituent components can be made of rigid or brittle materials, a support structure of the apparatus is adaptable for the arrangement of gravity fed, 'bag-like' flexible walled vessels.

There are many reagents/buffers, special-purpose solutions, solvents, paints, pesticides, herbicides, the list goes on, for commercial and personal use, used in research laboratories in small quantities. Very often, lab and QA (quality assurance) technicians, line employees, etc., need only a single batch that includes one or more 'flasks-full', for example, of a mixture tailored for a particular study/analysis/test or other use. Every time a new reagent, solvent, solution, or other mixture is needed, the laborious process of preparing begins, over again: The appropriate formula is pulled from laboratory files (or, if none, one must be calculated), bottles of the necessary ingredients are located and removed from storage, and ingredients are measured using equipment which has to, first, be cleaned and decontaminated from any prior use. Further, the process of mixing beverages such as is done at a wedding party, alumni gathering, or other function likewise requires small 'flasks' of different beverages requiring preparation in various batch-quantities. This is also true of the production process to prepare foodstuff in small amounts.

Traditionally, mixtures that are used in smaller quantities in production lines, commercial laboratories as well as private and government research laboratories, are prepared manually on an as-needed basis. First, a trained lab technician carefully measures out the requisite amount of each raw material-ingredient from the glass container(s) in which it was shipped to the lab and is currently being stored. Many reagents, solutions, and solvents are prepared using ingredients that are quite caustic and toxic. The quantities of ingredients measured for use, are mixed in an appropriately-sized beaker or flask. The highly labor intensive process of preparing solutions used in commercial manufacturing and research laboratories not only creates opportunity for human error and serious injury, but is also very costly.

Therefore, a versatile automatic, less labor-intensive and less error-prone process is needed. Preferably such a process is carried out using a computerized apparatus designed to be generally portable, with a footprint that can accommodate the limited available counter top space found in most laboratories, manufacturing environments, and eating establishments. The innovative apparatus and method described herein utilize a unique sophisticated technique to automatically; (a) access, dispense, and dose appropriate quantities of selected ingredients held in containment vessels in proximity to one another, this being done according to input entered through some type of user interface as well as a plurality of instructions/commands stored for automatic retrieval into computer memory, and (b) collect each such ingredient into a receptacle (such as a flask, beaker, etc.) for mixing and auttitraton (as desired). Although this new apparatus incorporates sophisticated automation techniques, its features allow for ready access to finished mixture-product. The unique automatic access to fluent ingredients, as well as dispensing and dosing techniques, can be employed by an apparatus with a footprint considered large (floor-model) or small (counter-top) to prepare a wide variety of mixtures.

Unlike the labor-intensive processes currently available, the new apparatus and associated method require much less intervention by a lab technician, line worker, etc. and provides sufficient production quality control over batch sizes of hundreds of flasks of prepared mixtures. As can be appreciated, within the spirit and scope of the design goals contemplated hereby, and as further described herein, many different types of suitable alternative structures for carrying out specified function(s) may be incorporated into the new apparatus and method of the invention. Further, the incorporation of flexible-walled vessels ('bag-type') having novel features invented by certain of the listed applicant-inventors hereof, and assigned to the assignee hereof, helps address problems associated with cumbersome transport and storage of heavy, breakable ceramic (e.g., glass) hard-walled containers. These unique flexible-walled vessels can be fabricated from many suitable materials into many different shapes and sizes, and filled with countless different types of fluent substance ingredients as needed for preparing desired mixtures.

SUMMARY OF THE INVENTION

It is a primary object of this invention to provide an apparatus and associated method of preparing a mixture using a computerized apparatus having a plurality of vessels, each of which is arranged on a support structure and oriented for dispensing a fluent substance through at least one exit port and a first flow channel. The first flow channel of each vessel is in further communication with a dedicated measurement assembly, for dosing fluent substance so dispensed, and a second flow channel. The apparatus also includes a receptacle support; and can further incorporate a user interface for receiving a first input concerning the mixture plus a storage device to hold instructions for locating a respective one of the second flow channels and the receptacle support in operative relation (for collecting the fluent substance in a mixture receptacle placed on the receptacle support). The apparatus can further comprise titration and mixing modules; and an alternative apparatus and method can utilize a support structure having a framework moveably coupled to a sustaining member, whereby many flexible-walled vessels can be accommodated.

Several advantages of providing the novel apparatus and associated method, follow:

(a) Versatility—The invention can be used for automatic preparation of single-flask batches of different mixtures, or repeated preparation of a large quantity (multiple flasks of one mixture).

(b) Structural design flexibility—An apparatus of the invention can stage a multitude of constituent fluent ingredients (including solvents, buffers/reagents, homogeneous and non-homogeneous solutions, titrants, including reactants, etc.) for access and dispensing depending on the instructions/commands and input received for the preparation of the preselected mire. The apparatus can be driven by its own power source (especially important for the field), or connected to an external source of power such as line voltage from an electrical wall outlet.

(c) Simplicity of use—Different batch-quantities of any one such mixture can readily be prepared with a touch of a keypad button or touch-sensitive screen, a voice command or joystick/mouse, etc. The new apparatus can be sized for portability and installed and relocated with ease and without disruption of surrounding environment. A user has at her fingertips, a panoply of programming instructions/commands for preparing hundreds of thousands of different mixtures as well as the flexibility to create new ones; and maintenancelcalibration can automated.

(d) Design flexibility—The apparatus can be sized to accommodate any number of ingredient vessels arranged and one or more of the vessels can be fed externally if usage of its contents is great throughout a day, for example. Also, many suitable mechanisms exist (and are handily adapted or redesigned) to carry out the following: receive user input, measure/dose fluent substances dispensed from a vessel, agitate/mix the substances, and titrate substances collected.

(e) Process speed and reliability/repeatability—Reducing the need for trained technicians to carry out each of the meticulous steps required to prepare the mixture(s), allows the process of preparing to occur at a faster rate, while being less prone to error (repeatability increases). This makes it possible to more-economically prepare a variety of preselected mixtures (regardless of batch quantities and/or product mix/variety requirements throughout a given day).

(f) Compact/efficient design—To optimize production, several apparatuses (built with a smaller footprint) can be positioned at different locations within a production or lab environment and operated simultaneously, or sequentially, to create different, or the same, mixtures. The use of flexible-walled bag type vessels, makes possible, on-the-fly replacement thereof.

(g) End-product preparation tracking—The automated features of the apparatus and method make tracking of batches for quality assurance or other purposes such as replenishing stock of fluent substances consumed straightforward to integrate and implement into existing production, eating establishment, and lab environments (especially where highly kegulated/monitored).

Briefly described, once again, the invention includes an apparatus for automatic preparation ot a preselected mixture, comprising: a plurality of vessels, each vessel arranged on a support structure and oriented for dispensing a fluent substance through at least one exit port and a first flow channel. Each of the first flow channels is in further communication with a dedicated measurement assembly and a second flow channel. The apparatus also has a receptacle support, a user interface for receiving a first input concerning the mixture, and a storage device holding a plurality of instructions for locating a respective one of the second flow channels and the receptacle support in operative relation for collecting the fluent substance. The mixtures which can be prepared utilizing the invention include liquid reagents, cleaning and other special-purpose solutions, solvents, pesticides, herbicides, paints, mixed beverages, fluent foodstuff, as well as other fluent substances used in the laboratory, manufacturing plant floor, field crops, gardens, eating establishments, building structures, art lab, and so on.

There are additional features that further distinguish this invention from known devices and methods: (a) the support structure comprises a framework moveably coupled to a sustaining member; (b) a dose actuator stationed in positional relationship with the receptacle support: (c) the vessels having been hermetically formed of flexible stock material into a 'bag-type' shape; (d) mixing and titration modules; and (e) further instructions on the storage device can include: instructions for dispensing from the first flow channel the requisite amount of fluent substance from a respective vessel; instructions for directing a respective one of the dedicated measurement devices to dose the fluent substance so dispensed; instructions for rotating, or otherwise moving/sliding/positioning/placing, a respective one of the vessels and/or an associated dedicated measurement assembly and/or the receptacle support, to position a respective second flow channel above the receptacle support; instructions for automatically mixing and/or titrating, including any type of analysis/reaction performed on or to, substances collected in a mixture receptacle; and instructions for repeating the process according to input about batch size/quantities.

The invention also includes a method of preparing a preselected mixture using a computerized apparatus, including the steps of (a) receiving a first input concerning the mixture; and (b) according to the first input and a plurality of instructions held on a storage device of the apparatus: automatically locating a second flow channel and a receptacle support in operative relation; dispensing a fluent substance through at least one exit port and a first flow channel from a respective one of a plurality of vessels arranged on a support structure of the apparatus, each of the first flow channels in further communication with a dedicated measurement assembly and a second flow channel; and using the measurement assembly, dosing the fluent substance so dispensed. The additional features listed above, further distinguish the method of the invention.

BRIEF DESCRIPTION OF THE DRAWINGS

For purposes of illustrating the flexibility of design and versatility of the innovative preferred apparatus and method, the invention will be more particularly described by referencing the accompanying drawings of embodiments of the invention (in which like numerals designate like parts). The figures have been included to communicate the features of the invention by way of example, only, and are in no way intended to unduly limit the disclosure hereof.

FIGS. 7A, 7B, and 7C are schematic representation (two side views and a top view, respectively of an alternative apparatus 250, again detailing certain features of the invention.

DETAILED DESCRIPTION OF THE PREFERRED EMBODIMENTS

Figure 1:
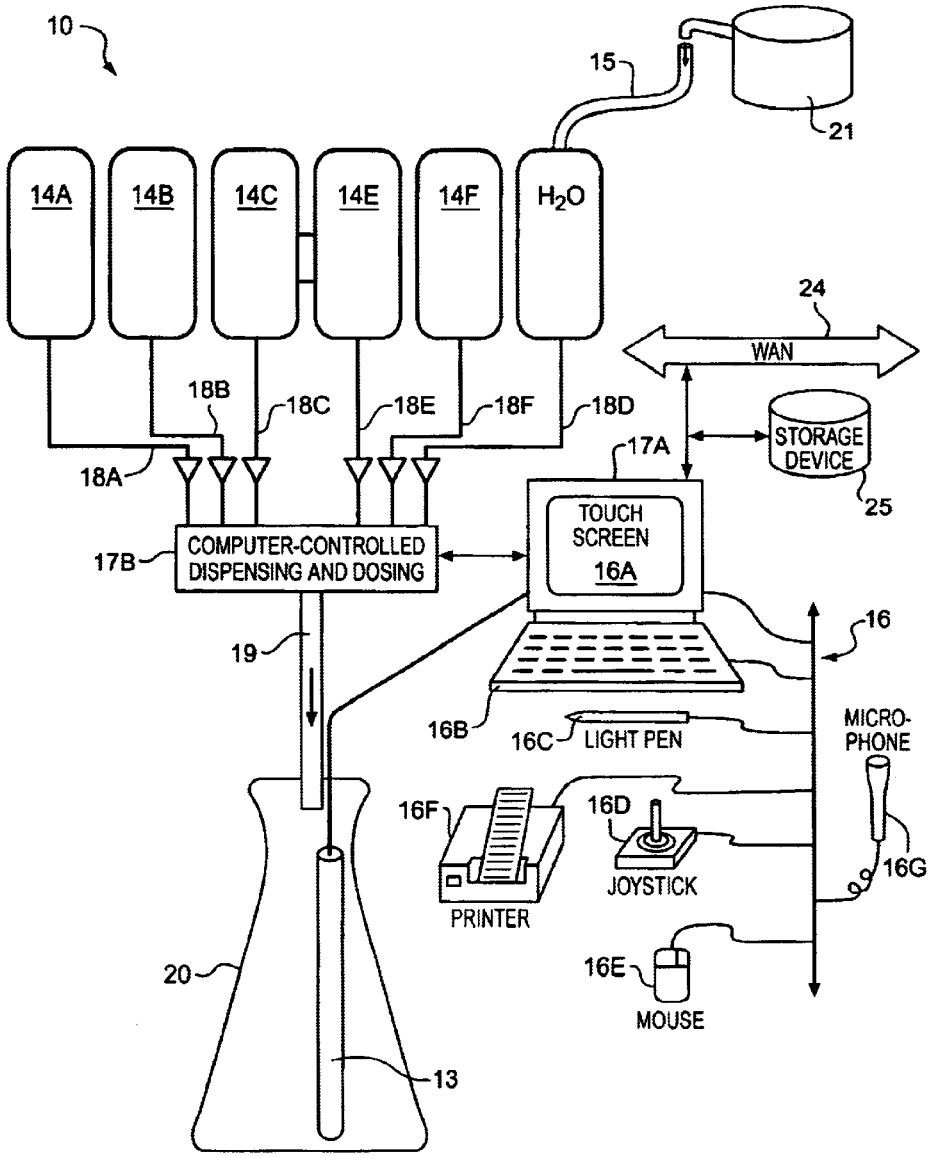
FIG. 1 diagrammatically illustrates features of a preferred apparatus 10 of the invention.

As identified above, the apparatus of the invention 10 is shown with several appropriately sized vessels labeled 14*a*–14*f* in fluent communication 18*a*–18*f* with a spout or collection channel 19 and into a receptacle 20. At some point prior to operating the apparatus, each vessel is filled with the fluent substance ingredient and arranged for dispensing along a respective channel 18a–18*f* according to amount of use throughout the period of operation. Vessels can be made of made of any sturdy flexible-walled or other material (e.g., a glass or other ceramic, a polymer, a metal alloy, and so on) that is compatible with the substance contained therein. Certain of the substances may be used so often during mixture preparation operations that it is beneficial to communicate with an external source. For example, the vessel 14*d* containing water is shown with conduit 15 and a valve, not shown, connected to an external source (such as, filtered/treated tap water) 21 to allow for uninterrupted resupply of vessel 14*d* throughout operations.

Operation of the vessel is represented at 17*a* as a processor in electrical communication with some type of storage device 25 (any peripheral unit or device, whether housed internally or externally hardwired or wireless, that holds data such as magnetic tape, magnetic disk optical disk, diskettes, flash cards, magnetic drums, and so on), a user interface 16 (such as a touch-sensitive screen or display 16*a*, keyboard/keypad 16*b*, light pen 16*c*, joysticks and trackballs 16*d*, mouse 16*e*, printer/OCR-scanner 16*f*, audio signal receiver/microphone 16*g* along with voice-recognition circuitry to digitize spoken words and enters them into the computer, and so on) for receiving input concerning the mixture selected, batch number, whether titration/reaction steps are to be performed, etc., and some type of wide area network (WAN) 24 that can be employed if input data is to be received or transmitted remotely such as through the global information network known as the INTERNET network. The user input can be any type suitable for the environment in which the apparatus will operate. For example, the apparatus may have to operate within a high humidity chamber or it may be used by gloved technicians with caustic materials on the outside of the gloves. In that case, it is preferably to chose a hermetically-sealed interface that is easy to activate (touch screen or voice-activated, for example). The user interface may also be one that is remote to the apparatus, such as outside the humidity chamber or offsite in a material storage warehouse. In this case, the user interface may be interconnected to computerized control system 17*a* via WAN 24. At 17*b* is a box representing the automated dispensing and dosing function(s) of the apparatus.

The apparatus and method of the invention are preferably carried out by incorporating a processing unit linked by a communication network, or bus, to both a user interface 16 (which can be something as simple a coded activation 'keys' pre-programmed for a preselected mixture preparation 'recipe') and internal memory that can call-up instructions stored on a storage device comprising the detailed sequence of instructions to direct the apparatus to perform the preparation steps. By way of background, central processing unit (CPU) chips and microprocessors have four functional sections: (1) the arithmetic/logic unit, (2) temporary storage locations, called registers, which hold data, instructions, or the results of calculations; (3) the control section; and (4) the internal bus, a network of communication lines that links internal CPU elements and offers several different data paths for input from and output to other elements of the computer system Computer, and computerized, refers to any general-purpose apparatus that processes data according to a set of instructions stored internally either temporarily or permanently. Data is stored both memory and on more-permanent storage units/devices. The semi-permanent or permanent holding place for data is generally called"storage" and memory is the more-temporary workspace for executing instructions and processing data. A set of instructions that perform a particular task is generally referred to as a program or software program.

Figure 2:
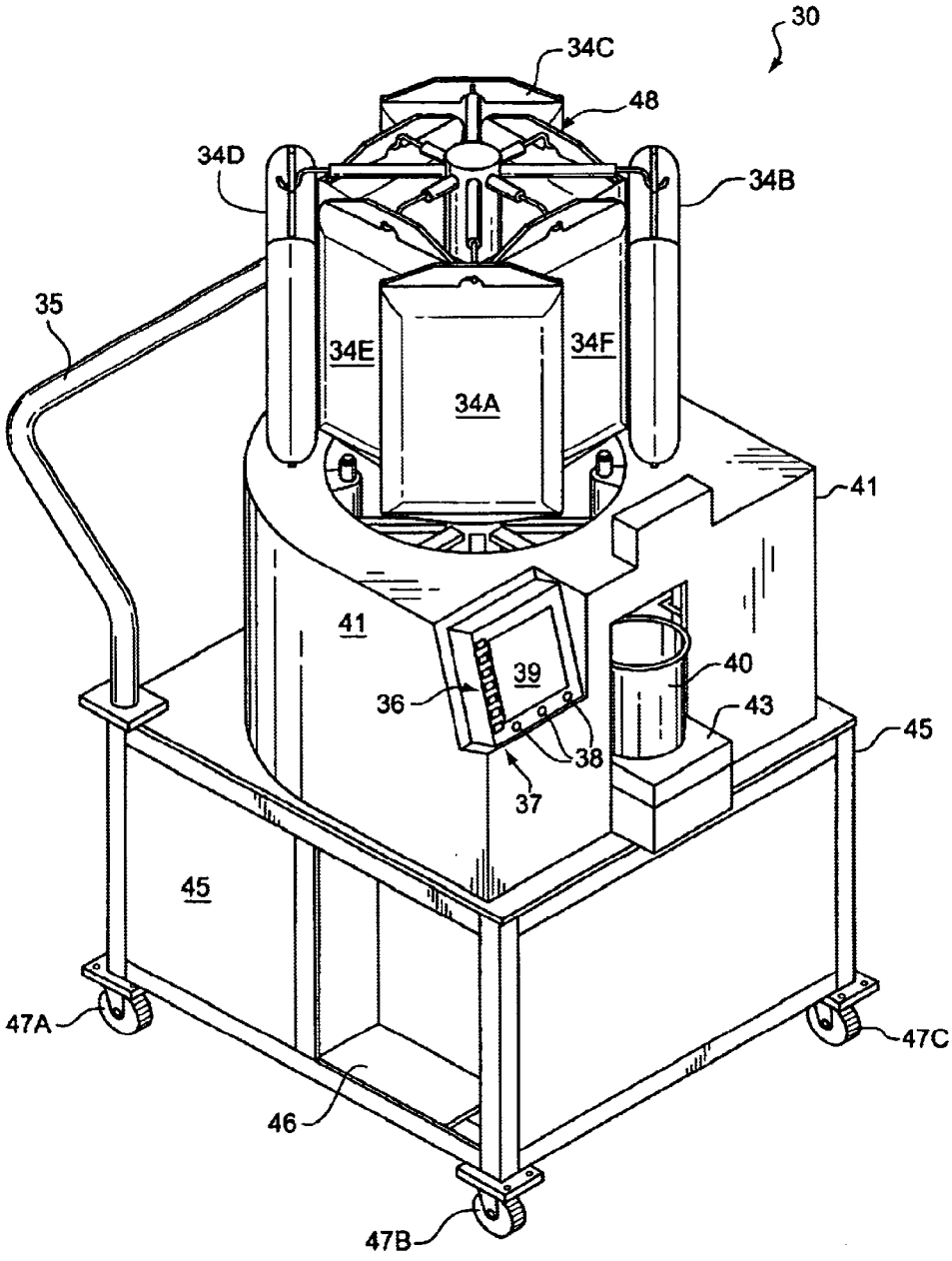
FIG. 2 is an isometric of a preferred apparatus 30 detailing further structural features.

FIG. 2 diagrammatically illustrates additional design features that further distinguish the apparatus 50 and method 300 of the invention from known processes and systems. Here, a housing or shroud 41, built of suitable structurally-sound material, covers several components of the apparatus as will be explained further. Each vessel (here, labeled 34*a*–34*f*) has been oriented on a centrally-located sustaining member 48 of a support structure (not labeled for simplicity) for is the purpose of unobstructed dispensing its contents into internal measuring equipment (as can be seen in FIGS. 3–5A and 5B with shroud 41 removed) for dosing and further final flow into the receptacle (such as the flask 40 positioned on receptacle support 43). In communication with the processor employed to carry out the instructions/comma for preparation of a mixture is user interface panel 36 having buttons/keys 37, an LED alphanumeric display 39, and LED indication lights 38 to communicate preparation status. As mentioned, any suitable user-input interface may be employed, including one remotely located. Base 45 is on rollers 47*a*–47*c* and has a handle 35 for portability. Receptacle support 43 is stationed on base 45 and shelving 46 has been added In FIG. 3, one can see how spokes 49*a*–49*f* of framework 48A may be rotatively coupled to axis member 48B which is, in turn, affixed to base 55. End-projections (59*a*, 59*c* in FIG. 4) of spokes 49*a*–49*f* extend through support openings 54*a*, 54*b* of the upper ends of bag-type flexible-walled vessels 34*a*–34*f*) as well as dedicated measurement assemblies 64*a*–64*f* can readily be seen. Extending below each assembly 64*a*–64*f* is a piston rod (respectively 68*a*–68*f*) and extending from each assembly 64*a*–64*f* is a flow channel (respectively 66*a*–66*f*) all of which will be further explained. Stationed in positional relationship with receptacle support 53 on base 55 is a dose actuator mechanism 80.

Figure 4:
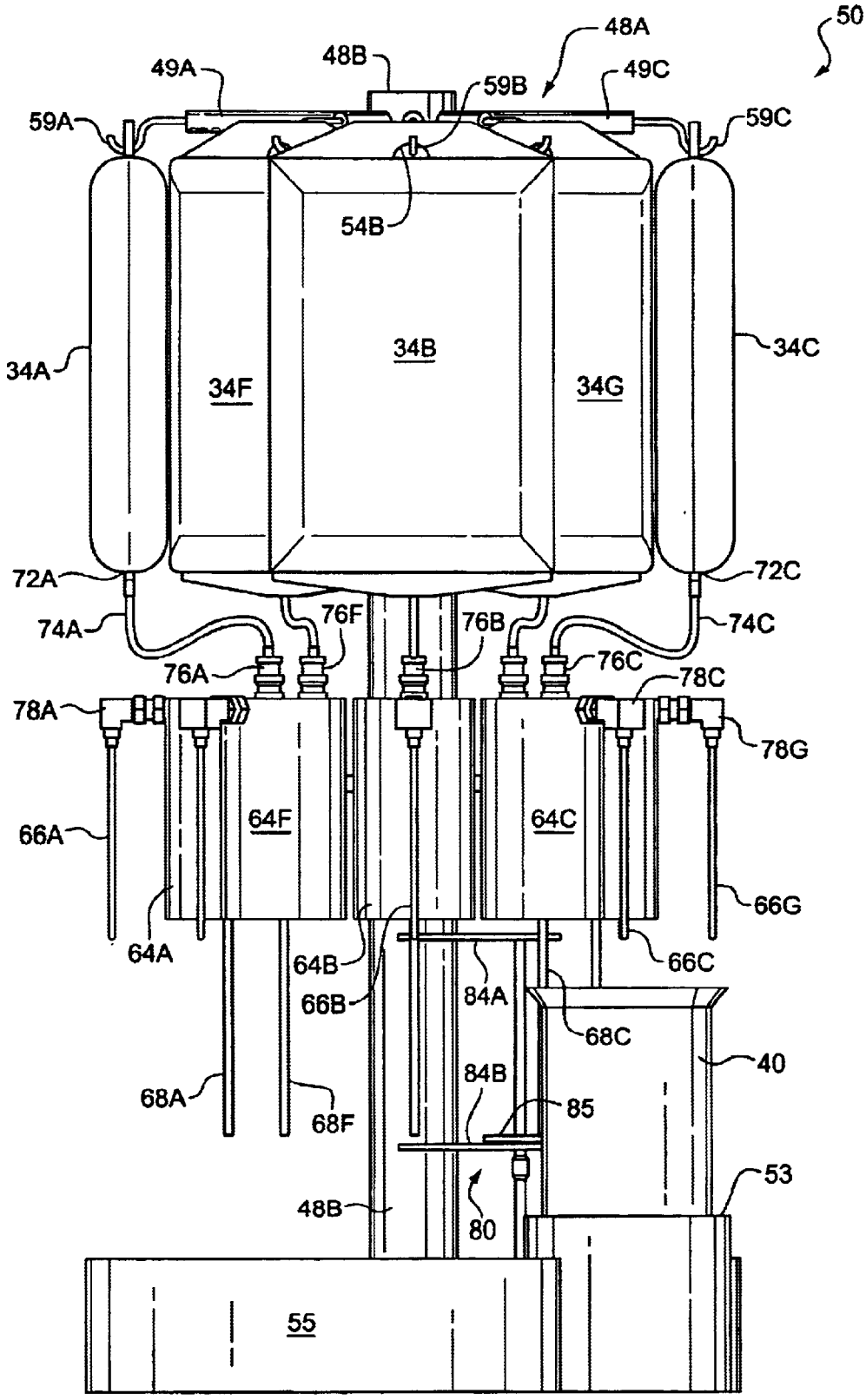
FIG. 4 is a side view of the alternative apparatus 50 in FIG. 3.

As can better be appreciated in FIG. 4, each vessel 34*a*–34*g* has a port (such as those labeled 72*a*, 72*c*) and a first flow channel (such as those labeled 74*a*, 74*c*) leading to a respective valve (preferably directional check valves) labeled 76*a*–76*f* and in communication with a respective measurement assembly 64*a*–64*f* and second flow channels 66*a*–66*g* which each include a hinged connector 78*a*–78*g* for design flexibility. One can see how receptacle support 53 has been located under assembly 64*c* for collecting fluent substance flowing from flow channel 66*c* into receptacle 40. Dose actuator mechanism 80 has extensions 84A, 84B to station it to base 55 via sustaining (axis) member 48B. In operation as designed (but certainly not limited to this particular structure) dose actuator 80 operates as follows (please see also FIG. 5A): A push-surface 85 is activated to push against a bottom end of a respective piston rod (such as that at 68*a*, 68*c*. 68*f*) in an upwardly direction to push a head (such as those labeled 67*a*, 67*c* in FIG. 5A) correspondingly upward to force the fluent substance dispensed into a respective piston cylinder volume (as labeled 64*a*, 64*c* in FIG. 5A), having passed through upstream valves 76*a*–76*f*. The novel dosing actuator 80 illustrated provides excellent dosing accuracy.

Figure 5A:
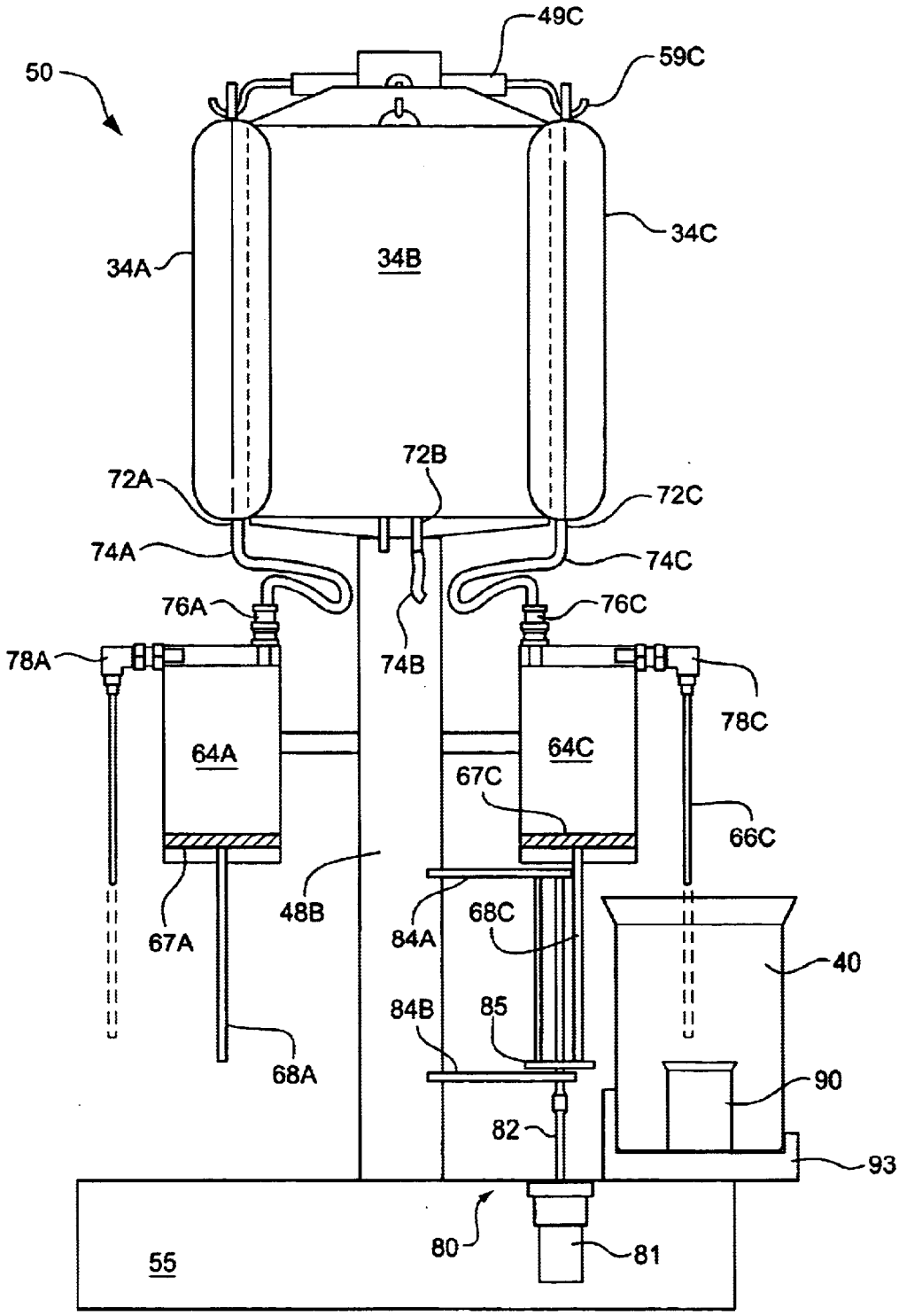
FIG. 5A is a schematic side view representation of the apparatus 50 illustrating many of the features shown in FIG. 4, in further detail.

Certain features can be better appreciated in FIG. 5A. Dose actuator 80 can have a motor 81 or other mechanism coupled to threaded dowel 82 to translate electrical power into mechanical drive power to activate push-surface 85. The actuator will be automatically controlled to size cylinder volume 64*a*, 64*c* as needed according to requisite dosage of fluent substance from a respective vessel. Projections 59*c* may be hook-shaped to anchor respective vessels 34*a*–34*g*

Figure 3:
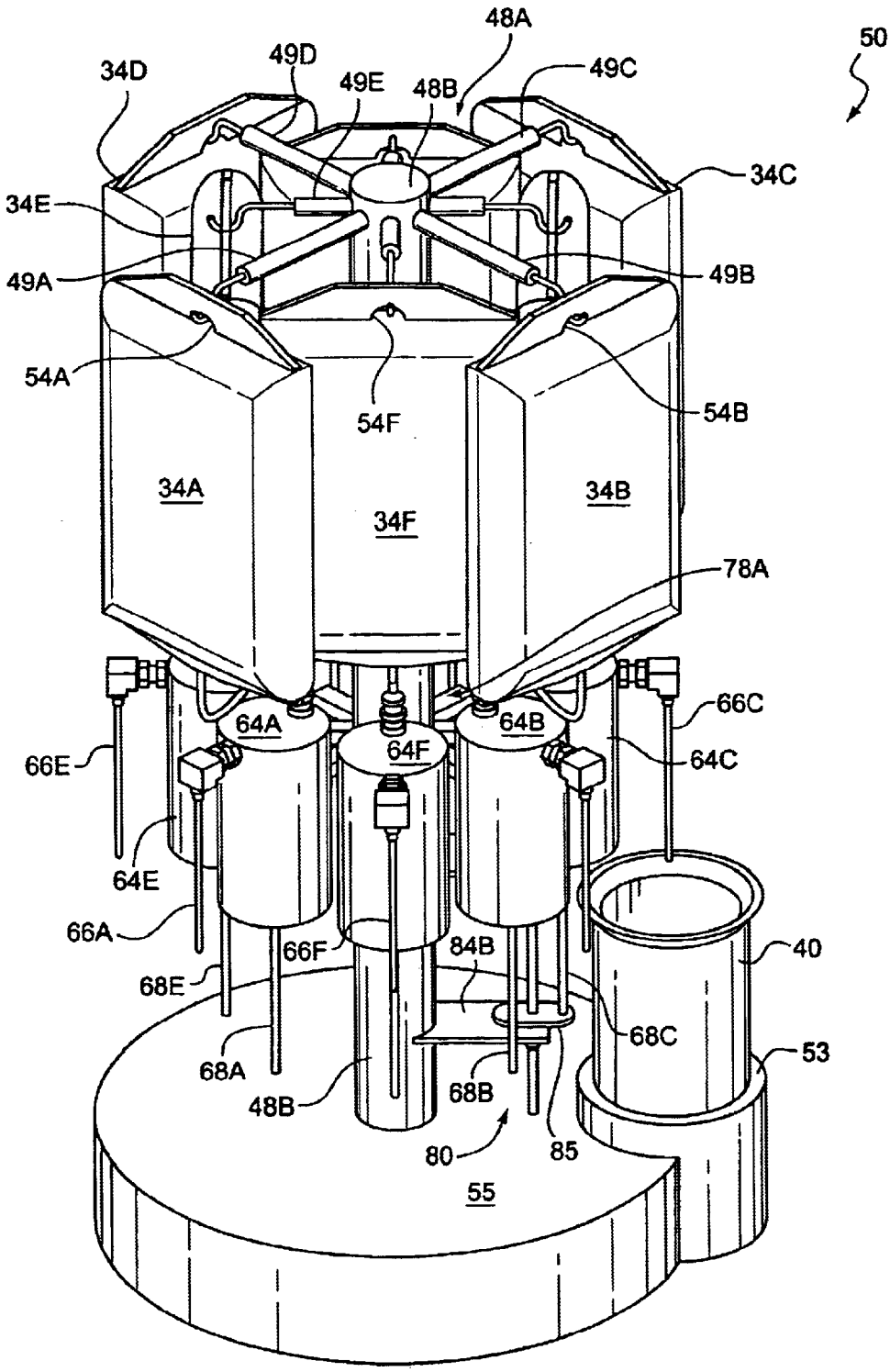
FIG. 3 is an isometric of an alternative apparatus labeled 50, with shroud 41 removed and certain other features slightly altered.
Figure 5B:
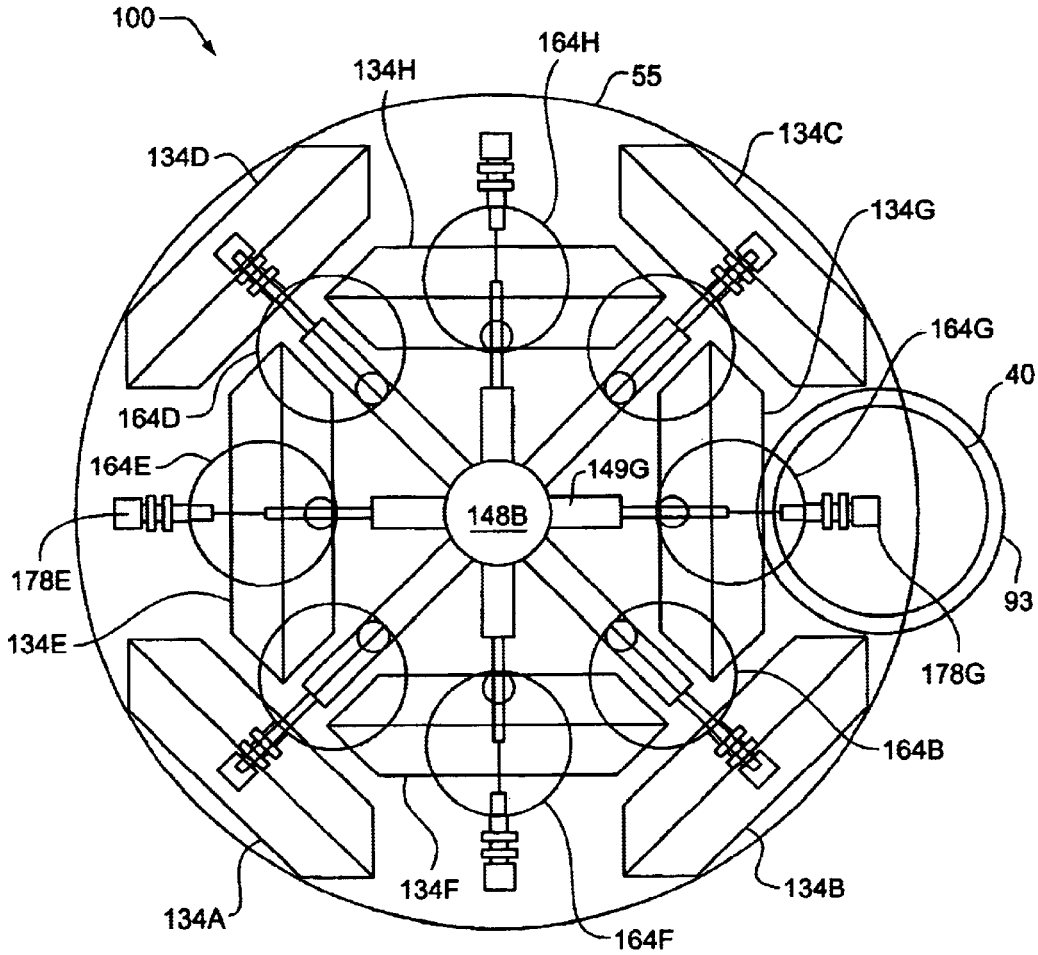
FIG. 5B is a schematic top view of an alternative apparatus 100 to show representative locations of certain of the features.

Corresponding structure in alternative apparatus 100 of FIG. 5B includes: circuitously arranged vessels 134*a*–134*g* on framework (including spoke 149*g*) coupled to axis member 148B, measurement assemblies 164*a*–164*g* circuitously arranged on the framework (supporting spokes for the assemblies 164*a*–164*g* are not in view, here, but can be seen in FIG. 3 and labeled 78A), and receptacle 40 on receptacle support 93 is shown in operative relation with second flow channel hinge 178*g* and vessel 134*g*.

Figure 6:
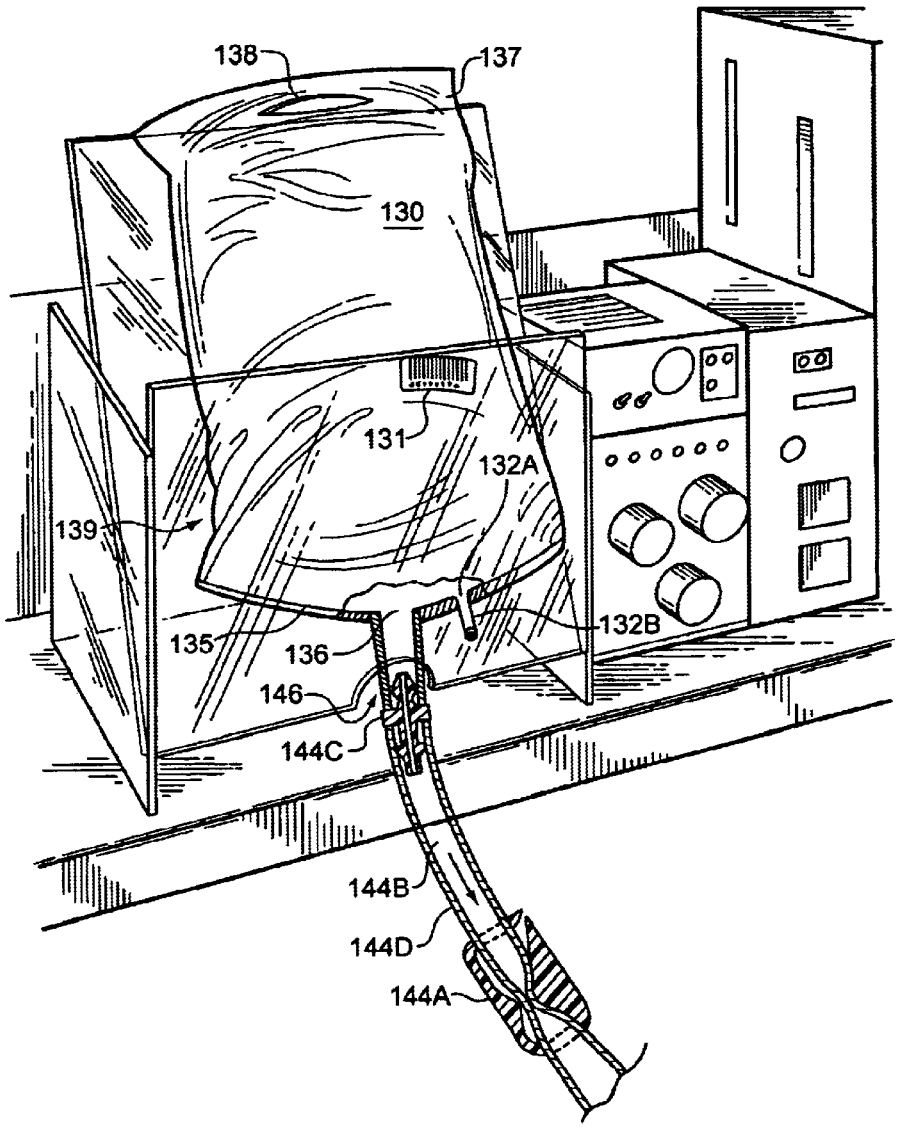
FIG. 6 is an isometric illustrating a preferred flexible-walled vessel 130 of the invention in use alongside laboratory-type equipment supported by an alternative framework.

The flexible-walled vessel 130 of FIG. 6 has an upper-end 137 through which an opening 138 passes. A lower-end 139 has an exit port 136 and a flow channel 144B having tubular outer wall 144D, is in further communication with connector 144C and a pinch-type valve 144A. An additional port 132A (such as for filling the vessel) has been permanently closed at 132B.

Figure 7A:
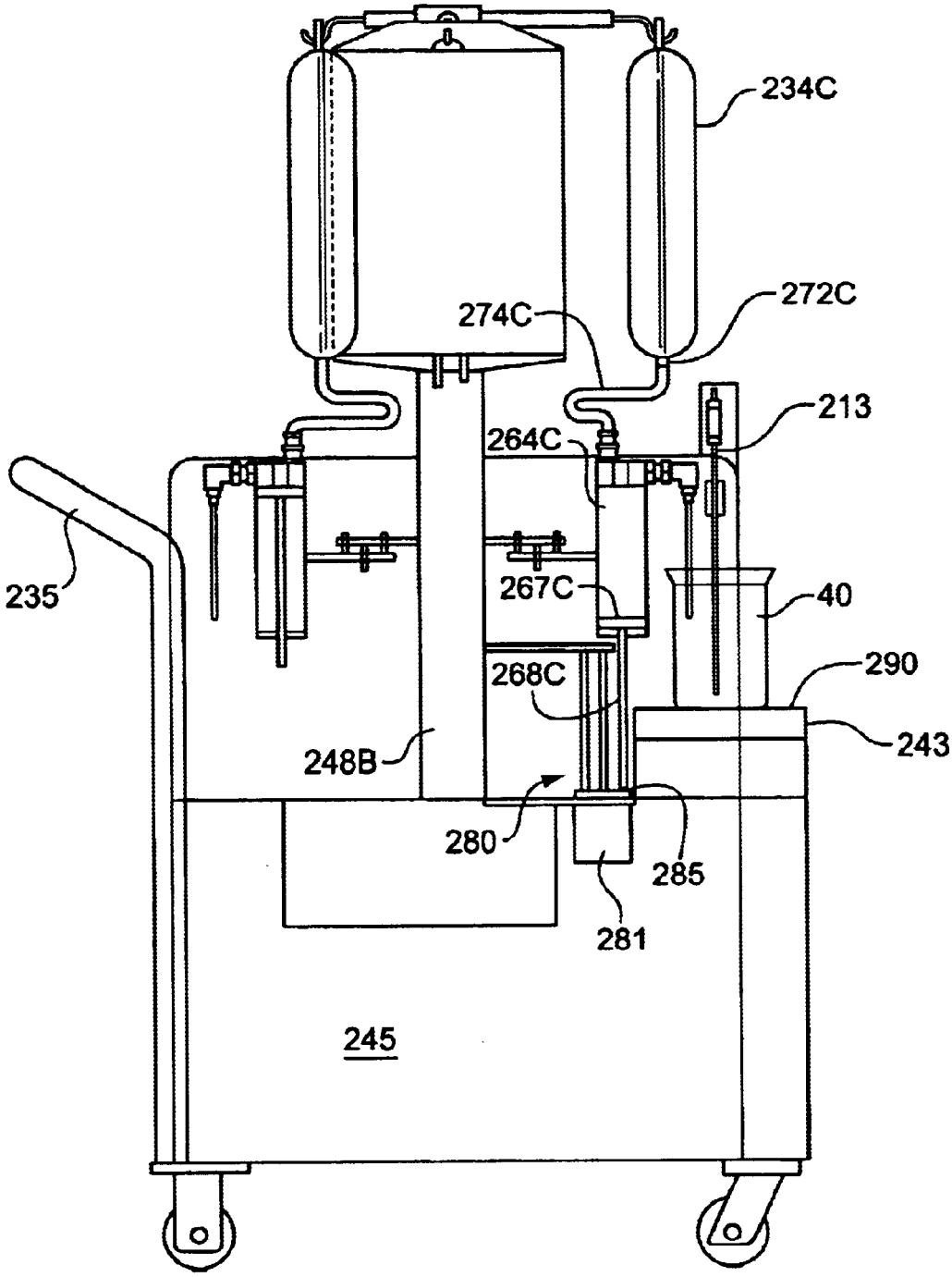
Figure 8A:
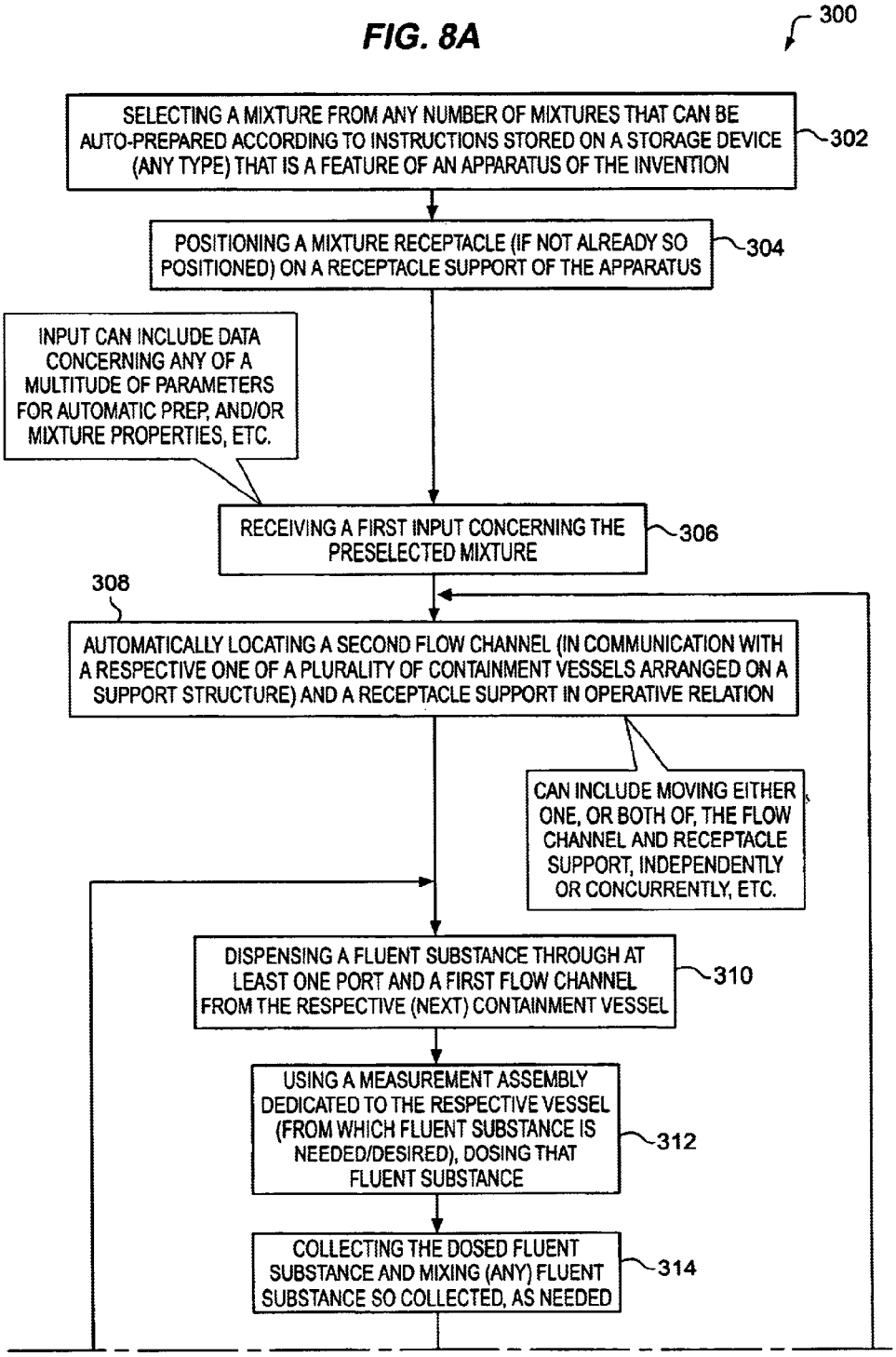
FIGS. 8A and 8B are a flow diagram detailing preferred steps, in an expanded novel manner, of a method 300 of preparing a preselected mixture using a unique apparatus of the invention.
Figure 8B:
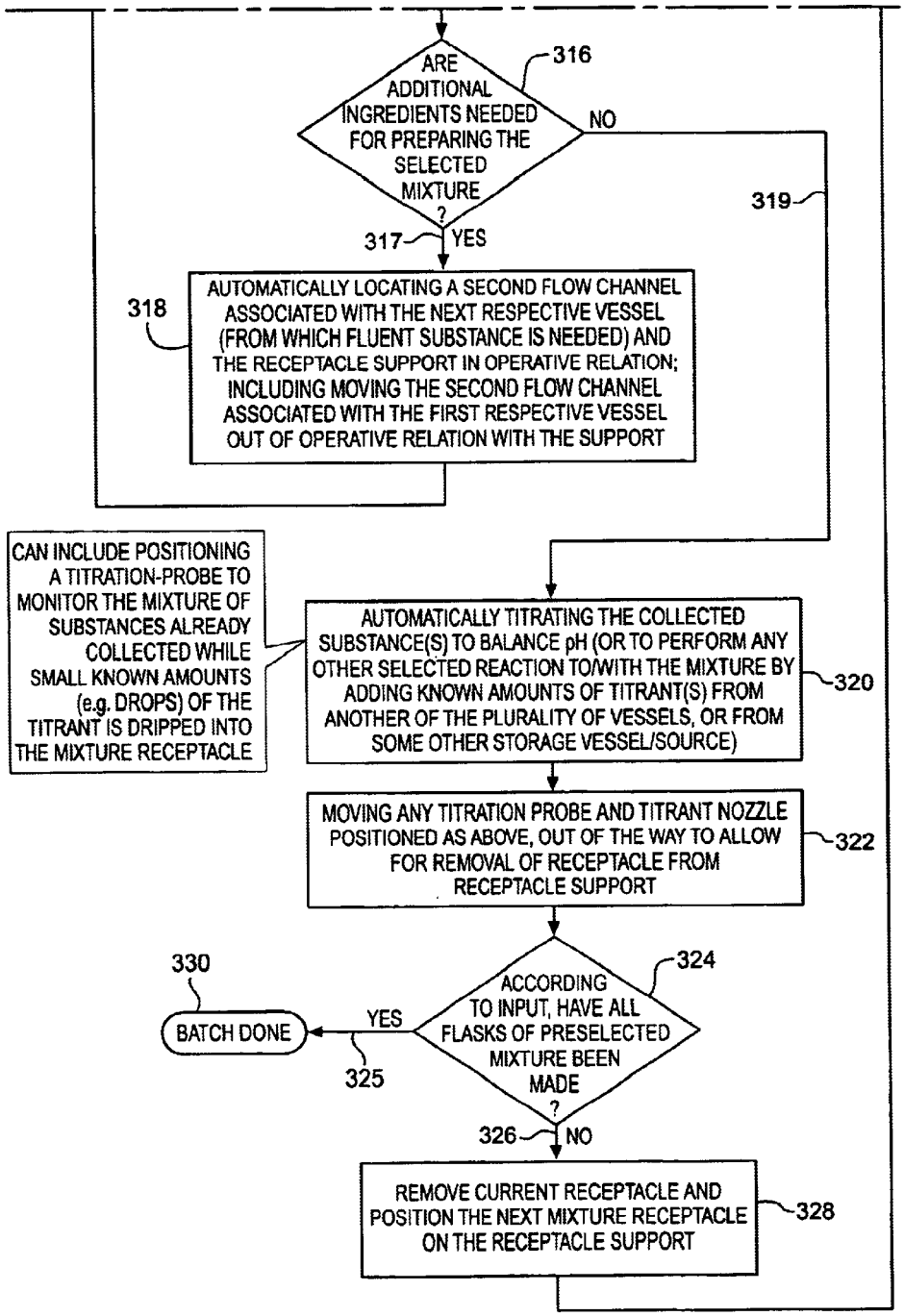

The apparatus 250 of FIGS. 7A–7C views, have structure corresponding to that in FIGS. 2, 3, 4, 5A–5B as can be readily appreciated, including a titration probe 213 (for automatic titration, represented at box 320 in FIG. 8B, of the mixture to balance its pH, or to perform some other special operation/reaction to meet a desired substance parameter) and mixer assembly 290 (having a suitable agitator device, such as a stir-rod or magnetic stir dowel, may be lowered to mix collected substances together). Likewise, one can better appreciate the novel features of the method 300 of the invention as illustrated by way of a flow diagram in FIGS. 8A and 8B. Without further additional commentary provided here, one can readily appreciate the features of the invention from specific written detail added to FIGS. 8A and 8B for convenient viewing, of the steps illustrated.

Fluent substances, as that term is used herein, includes the multitude of substances considered flowable, or capable of flowing already identified such as reagents cleaning solutions, water (with many uses, including use as an inorganic solvent), organics, pesticides, and other substances used in a production/test type environment. 'Reagent', as defined, is any chemical compound used in laboratory analyses to detect and identify specific constituents of the material being examined. Though reagents may be gases, liquids, or solids, they are usually prepared as solutions (in water or common solvents) of various concentrations, e.g., 1 molar, 0.1 normal. etc. Several thousand chemicals of varying specificity are used as reagents; they are subject to strict specifications, especially as regards purity. A non-exhaustive list of reagents includes, without limitation: glacial acetic acid; sulfuric acid: hydrogen sulfide; dimethylglyoxime; potassium iodide; 0.05 M Potassium Phosphate, pH 7.5; Sodium Acetate Buffer Solution, pH 5.0; 5% SLS in 0.1 M Phosphate Buffer (pH 8.0); 0.05 M Potassium Phosphate, pH 6.8; 0.025 M Phosphate pH 3.2, has Phosphoric and Acetic Acid; 0.05 M Sodium Phosphate pH 6.8; 0.2% diethylamine in 0.2 M Potassium Phosphate. Generally, 'solvent' is a term that designates a liquid which can reduce certain solids or liquids to molecular or ionic form by relaxing the intermolecular forces that unite them. There are tens-of-thousands of solvents currently in use.

While certain representative embodiments and details have been shown merely for the purpose of illustrating the invention, those skilled in the art will readily appreciate that various modifications may be made to the invention without departing from the novel teachings or scope of this invention. Accordingly, all such modifications are intended to be included within the scope of this invention as defined in the following claims. Although the commonly employed preamble phrase "comprising the steps of" may be used herein, or hereafter, in a method claim, the Applicants in no way intend to invoke limitations of 35 USC section 112 ¶6. Furthermore, in any claim that is filed herein or hereafter, any means-plus-function clauses used, or later found to be present, are intended to cover the structures described herein as performing the recited function and not only structural equivalents but also equivalent structures.

What is claimed is:

1. An apparatus for automatic preparation of a preselected mixture, comprising:

a plurality of vessels, each vessel is flexible-walled with an associated first flow channel hermetically extending from an exit port and is arranged on a support structure and oriented for dispensing a fluent substance through at least said exit port and said first flow channel, each said first flow channel in further communication with a dedicated measurement assembly and a second flow channel;

a receptacle support;

a user interface for receiving a first input concerning the mixture; and a storage device holding a plurality of instructions for locating a respective one of said second flow channels and said receptacle support in operative relation for collecting said fluent substance.

2. The apparatus of claim 1 wherein the mixture is selected from the group consisting of liquid reagents, cleaning solutions, solvents, pesticides, herbicides, paints, mixed beverages, and fluent foodstuff; said instructions for locating further comprises instructions for rotating a respective one of said plurality of vessels to position said respective second flow channel above said receptacle support; and said plurality of instructions further comprises instructions for directing a respective one of said dedicated measurement assemblies to dose, according to said input, said fluent substance so dispensed.

3. The apparatus of claim 1 wherein:

said support structure comprises a framework rotatively coupled to an axis member, said vessels are circuitously arranged on said framework; an upper-end and a lower-end of each said vessel has been hermetically formed from a flexible stock material and pre-filled to contain said fluent substance said framework comprises a plurality of projections, each said projection to fit through a support opening of said upper-end to bold a respective one of said plurality of vessels; and the apparatus further comprises a dose actuator stationed in positional relationship with said receptacle support.

4. The apparatus of claim 3 wherein said measurement assemblies are circuitously arranged on said framework in proximity to said vessels; each said measurement assembly being movable vertically along said axis member, and further comprising a piston chamber within which a head connected to a first end of a rod is disposed; said respective second flow channel to comprise a tubular-extension; and said operative relation for collecting to comprise said tubular-extension located over said receptacle support.

5. The apparatus of claim 1 wherein: said support structure comprises a framework rotatively coupled to a sustaining member, said vessels and measurement assemblies are circuitously arranged on said, framework; and the apparatus further comprises a mixer stationed in positional relationship with said receptacle support.

6. The apparatus of claim 5 comprising a mixture receptacle on said receptacle support; and wherein said first input comprises information about a preselected number of batches and a chemical make-up of the mixture; said sustaining member is an axis member, each said measurement assembly vertically movable there along; and said user interface comprises a display.

7. The apparatus of claim 1 wherein said support structure comprises a framework coupled to a sustaining member; and further comprising a portable base to which said sustaining member is affixed, a titration module stationed in positional relationship with said receptacle support, and a dose actuator stationed in positional relationship with said receptacle support upon said base.

8. An apparatus for automatic preparation of a preselected mixture, composing:

a plurality of vessels, each vessel arranged on a support structure and oriented for dispensing a fluent substance through at least one exit port and a first flow channel, each said first flow channel in further communication with a dedicated measurement assembly and a second flow channel, said support structure comprising a framework, said vessels circuitously arranged on said framework;

a receptacle support;

a user interface for receiving a first input concerning the mixture;

a storage device holding a plurality of instructions for locating a respective one of said second flow channels and said receptacle support in operative relation for collecting said fluent substance;

a dose actuator stationed in positional relationship with said receptacle support;

a dedicated check valve upstream of each of said measurement assembly, and wherein: an upper-end and a lower-end of each said vessel has been hermetically formed from a flexible tubular stock material; said framework comprises a plurality of projections, each said projection to fit through a support opening of said upper-end to hold a respective one of said plurality of vessels; and each said measurement assembly further comprises a piston chamber within which a head connected to a first end of a rod is disposed.

9. The apparatus of claim 8 wherein said dose actuator comprises a push-surface in connection with a movable linkage, whereby upward movement of said push-surface against a second end of a respective one of said rods causes said head to force any said fluent substance within said piston chamber out and through said respective second flow channel.

10. An apparatus for automatic preparation of a preselected mixture, comprising:

a plurality of vessels, each vessel arranged on a support structure and oriented for dispensing a fluent substance through at least one exit port and a first flow channel, each said first flow channel in further communication with a dedicated measurement assembly and a second flow channel;

a receptacle support;

a user interface for receiving a first input concerning the mixture;

a storage device holding a plurality of instructions for locating a respective one of said second flow channels and said receptacle support in operative relation for collecting said fluent substance; and wherein: said support structure comprises a framework movably coupled to a sustaining member, said vessels are arranged on said framework; and the apparatus further comprises a titration module and a mixer, each stationed in positional relationship with said receptacle support.

11. The apparatus of claim 10 wherein the mixture is selected from the group consisting of liquid reagents, cleaning solutions, solvents, pesticides, herbicides, paints, mixed beverages, and fluent foodstuff; said instructions for locating further comprises instructions for positioning said receptacle support under said respective second flow channel; and said plurality of instructions further comprises instructions for directing a respective one of said dedicated measurement assemblies to dose, according to said input, said fluent substance so dispensed.

12. An apparatus for automatic preparation of a preselected mixture, comprising:

a plurality of vessels, each vessel arranged on a support structure and oriented for dispensing a fluent substance through at least one exit port and a first flow channel, each said first flow channel in further communication with a dedicated measurement assembly and a second flow channel;

a receptacle support;

said support structure comprises a framework rotatively coupled to a sustaining member, said vessels and measurement assemblies are circuitously arranged on said framework; and the apparatus further comprises a mixer stationed in positional relationship with said receptacle support;

a user interface for receiving a first input concerning the mixture;

a storage device holding a plurality of instructions for locating a respective one of said second flow channels and said receptacle support in operative relation for collecting said fluent substance; and a titration module stationed in positional relationship with said receptacle support; each of said vessels is flexible-walled with an associated said first flow channel hermetically extending from a respective exit port; and wherein said framework comprises a plurality of outwardly extending spokes upon which said flexible-walled vessels hang.

13. A method of preparing a preselected mixture using a computerized apparatus, comprising the steps of:

arranging a plurality of flexible-walled vessels on a support structure of the apparatus, at least one of said vessels having been pre-filled with a fluent substance and having a first flow channel hermetically extending from an exit port;

receiving a first input concerning the mixture; and according to said first input and a plurality of instructions held on a storage device of the apparatus: automatically locating a second flow channel and a receptacle support in operative relation; dispensing said fluent substance through a lease said exit port and said first flow channel from a two one of a plurality of ,each said first flow channel in further communication with a dedicated measurement assembly and said second flow channel; and using said measurement assembly, dosing said fluent substance so dispensed.

14. The method of claim 13 further comprising the steps of positioning a mixture receptacle on said receptacle support, collecting said dosed fluent substance in said mixture receptacle, and further according to said first input, automatically titrating said collected fluent substance; and wherein said step of automatically locating said second flow channel further comprises rotating said respective vessel and a respective one of said dedicated measurement assemblies such that said second flow channel is over said mixture receptacle.

15. The method of claim 13 wherein:

said step of automatically locating said second flow channel further comprises moving said receptacle support under said second flow channel; and said step of dosing further comprises the steps of allowing said dispensed fluent substance to pass through a check valve in communication with said first flow channel and into a volume of a piston chamber of a respective one of said dedicated measurement assemblies, and actuating a dose actuator stationed in positional relationship with said receptacle support.

16. The method of claim 15 wherein:

said step of automatically locating said second flow channel further comprises also moving, vertically along a sustaining member of said support structure, said respective dedicated measurement assembly; and said step of actuating further comprises moving, in an upwardly direction, a push-surface of said dose actuator against a second end of a rod connected to a head disposed within said piston chamber.

17. The method of claim 13 wherein said step of arranging a plurality of flexible-walled vessels further comprises hanging each of said flexible-walled vessels on a framework of said support structure; and further comprising the steps of: positioning a mixture receptacle on said receptacle support; collecting said dosed fluent substance in said mixture receptacle; and further according to said first input, automatically moving a framework of said support structure so that said second flow channel associated with said respective vessel is no longer in said operative relation with said receptacle support, and locating another of said second flow e m channels that is in communication with a second one of said plurality of vessels over said receptacle support.

18. The method of claim 18 further comprising the steps of:

dispensing a second fluent substance through at least one second vessel port and a first flow channel from said second vessel;

using a second one of said dedicated measurement assemblies in communication with said first flow channel from said second vessel, dosing said second fluent substance so dispensed;

collecting said dosed second fluent substance in said mixture receptacle;

automatically titrating said collected fluent substances.

19. A method of preparing a preselected mixture using a computerized apparatus, comprising the steps of:

receiving a first input concerning the mixture;

preselecting said mixture from the group consisting of liquid reagents, cleaning solutions, solvents, pesticides, herbicides, paints, mixed beverages, and fluent foodstuff, and manually entering said first input, comprising said preselection, through a user interface of the apparatus;

according to said first input and a plurality of instructions held on a storage device of the apparatus: automatically locating a second flow channel and a receptacle support in operative relation by rotating said respective vessel and a respective one of said dedicated measurement assemblies such that said second flow channel is over said mixture receptacle; dispensing a fluent substance through at least one exit port and a first flow channel from a respective one of a plurality of vessels arranged on a support structure of the apparatus, each said first flow channel in further communication with a dedicated measurement assembly and said second flow channel; and using said measurement assembly, dosing said fluent substance so dispensed;

collecting said dosed fluent substance in said mixture receptacle;

mixing said collected fluent substance; and further according to said first input, automatically titrating said collected fluent substance to balance pH thereof.

20. A method of preparing a preselected mixture using a computerized apparatus, comprising the steps of:

receiving a first input concerning the mixture;

according to said first input and a plurality of instructions held on a storage device of the apparatus: automatically locating a second flow channel and a receptacle support in operative relation; dispensing a fluent substance through at least one exit port and a first flow channel from a respective one of a plurality of vessels arranged on a support structure of the apparatus, each said first flow channel in further communication with a dedicated measurement assembly and said second flow channel; and Using said measurement assembly, dosing said fluent substance so dispensed;

positioning a mixture receptacle on said receptacle support, collecting said dosed fluent substance in said mixture receptacle;

mixing said collected fluent substances within said mixture receptacle; and further according to said first input, automatically titrating said collected fluent substances to balance pH thereof, comprising inserting a pH probe into said collected fluent substances and adding pH solution as directed.

21. An apparatus for automatic preparation of a preselected mixture, comprising:

a plurality of vessels, each vessel arranged on a support structure and oriented for dispensing a fluent substance through a first flow channel that is in further communication with a dedicated measurement assembly for dosing said substance so dispensed; a receptade support;

a user interface for receiving a first input concerning the mixture; and a storage device holding a plurality of instructions for said dosing, according to said input; and a titration module and a mixer, each stationed in positional relationship with said receptacle support.

22. An apparatus for automatic preparation of a preselected mixture, comprising:

a plurality of vessels, each vessel arranged on a support structure and oriented for dispensing a fluent substance through at least one exit port and a first flow channel, each said first flow channel in further communication with a dedicated measurement assembly and a second flow channel;

a receptacle support;

a user interface for receiving a first input concerning the mixture;

a storage device holding a plurality of instructions for locating a respective one of said second flow channels and said receptacle support in operative relation for collecting said fluent substance; and a titration module stationed in positional relationship with said receptacle support.

23. The apparatus of claim 22 wherein: the mixture is selected from the group consisting of liquid reagents, cleaning solutions,:solvents, pesticides, herbicides, paints, mixed beverages, and fluent foodstuff; and at least one of said vessels is flexible-walled and pre-filled with said fluent substance with said first flow channel hermetically extending from said exit port, said first flow channel being flexible.

24. A method of preparing a preselected mixture using a computerized apparatus, comprising the steps of:

receiving a first input concerning the mixture; and according to said first input and a plurality of instructions held on a storage device of the apparatus: automatically locating a second flow channel and a receptacle support in operative relation by rotating said respective vessel and a respective one of said dedicated measurement assemblies such that said second flow channel is over said mixture receptacle; dispensing a fluent substance through at least one exit port and a first flow channel from a respective one of a plurality of vessels arranged on a support structure of the apparatus, each said first flow channel in further communication with a dedicated measurement assembly and said second flow channel; using said measurement assembly, dosing said fluent substance so dispensed; collecting said dosed fluent substance in said mixture receptacle; and automatically titratiug said collected fluent substance.

* * * * *